US006848192B2

(12) United States Patent
Partin

(10) Patent No.: US 6,848,192 B2
(45) Date of Patent: Feb. 1, 2005

(54) SIDING TOOL

(76) Inventor: Glen C. Partin, 189 County Rd. 4874, Dayton, TX (US) 77535

( * ) Notice: Subject to any disclaimer, the term of this patent is extended or adjusted under 35 U.S.C. 154(b) by 115 days.

(21) Appl. No.: 10/330,392

(22) Filed: Dec. 30, 2002

(65) Prior Publication Data

US 2004/0123478 A1 Jul. 1, 2004

(51) Int. Cl.[7] ..... G01D 21/00

(52) U.S. Cl. ..... 33/647; 33/613; 33/626; 33/649

(58) Field of Search ..... 33/646–649, 613, 33/626, 411

(56) References Cited

U.S. PATENT DOCUMENTS 4,155,175 A * 5/1979 Stiles ..... 33/646
4,425,714 A 1/1984 Kelly, Jr.
5,400,519 A * 3/1995 Meyer ..... 33/646
5,408,757 A 4/1995 Lenz
5,465,499 A * 11/1995 LaPlante ..... 33/647
5,623,767 A * 4/1997 Colavito ..... 33/647
5,692,311 A * 12/1997 Paquin ..... 33/647
D406,069 S 2/1999 Boyce
6,334,259 B1 * 1/2002 Harvey ..... 33/42
6,367,160 B1 * 4/2002 Rempe ..... 33/647
6,434,853 B2 * 8/2002 Pyburn ..... 33/647
6,484,411 B1 * 11/2002 Nixon ..... 33/411
6,494,016 B1 * 12/2002 Bankson ..... 33/647

* cited by examiner

*Primary Examiner*—Christopher W. Fulton
*Assistant Examiner*—Yaritza Guadalupe
(74) *Attorney, Agent, or Firm*—Richard C. Litman

(57) ABSTRACT

A siding tool is provided that enables a single person to install plank siding on a building. The main body of the tool is provided in the form of a flat elongated bar. The top end of a flat elongated bar is bent 180 degree to form a hook. The tip portion of the hook is tapered to facilitate insertion behind a previously installed plank of siding. The main body includes neck portion attached to the hook. The neck portion has a threaded aperture there through that is positioned a predetermined distance from the top end of the bar. The bar further includes two 30-degree bends resulting in the formation of an angled extension portion connected to the neck portion and a handle portion connected to the extension portion. A movable member is provided in the form of a short generally flat bar having two 90-degree bends therein defining a foot portion with a bolt-receiving aperture there through and a seat portion. A bolt is threadedly received in the threaded aperture of the neck portion and passes through the bolt-receiving aperture of the foot portion of said movable member. A well nut cooperates with the bolt to secure the movable member in position on the main body for receiving an uninstalled plank of siding on the seat portion.

7 Claims, 3 Drawing Sheets

SIDING TOOL

BACKGROUND OF THE INVENTION

1. Field of the Invention

The present invention relates to tools for installing plank siding and more particularly to tools that facilitate installation of plank siding on a building by a single person.

2. Description of the Related Art

The prior art shows a myriad of installation tools that enable one person to simply and easily install siding to buildings. These tools generally include a hook for supporting the tool on an installed plank of siding and a means of supporting an uninstalled plank with the tool. A frequent problem with use of the prior art devices is task of removing the tools from underneath the installed planks. For example, U.S. Pat. No. 5,408,757 issued Apr. 25, 1995 to Lenz teaches about the difficulties encountered in removing the tools. Lenz describes a jig for installing lap siding that has a hook portion with a selected strength and elastic memory. The physical properties of the tool allow the hook to be strong enough to support the weight of a piece of siding that is being installed while being resilient enough to allow the hook to straighten out when the jig is pulled forcefully downwardly to slide the jig from between the installed siding pieces and readily reassume its former hook shape.

U.S. Pat. No. 4,425,714 issued Jan. 17, 1984 to Kelly, Jr. teaches a siding board installation tool that has a channel for supporting an uninstalled plank. The channel is formed with a moveable gate member having one position for engaging the uninstalled plank and another position which allows the tool to be lifted to free the hook and pulled downwardly between the two planks before the uninstalled plank is secured to the structure.

Design Pat. No. 406,069 issued Feb. 23, 1999 shows an installation tool for lap siding design which appears to have a seat for the uninstalled plank that is moved by a worm gear operatively attached to the hook of the tool.

None of the above inventions and patents, taken either singularly or in combination, is seen to describe the instant invention as claimed. Thus a siding tool solving the aforementioned problems is desired.

SUMMARY OF THE INVENTION

The present invention provides a tool for facilitating the installation of plank siding on a building by a single person. The main body of the tool is in the form of a flat elongated bar. The top end of a flat elongated bar is bent 180 degree to form a hook. The tip portion of the hook is tapered to facilitate insertion behind a previously installed plank of siding. The main body includes neck portion attached to the hook. The neck portion has a threaded aperture there through that is positioned a predetermined distance from the top end of the bar. The bar further includes two 30-degree bends resulting in the formation of an angled extension portion connected to the neck portion and a handle portion connected to the extension portion. The handle portion extends in a spaced parallel relation to the neck portion to facilitate easy grasping of the handle for positioning and removal of the tool.

The tool also includes a movable member in the form of a short flat bar with two 90-degree bends defining a foot portion with a bolt-receiving aperture therethrough and a seat portion for supporting one end of a plank of siding being installed on a building.

A fastener element in the form of a bolt is threadedly received in the threaded aperture of the main body of the tool. The bolt is passed through the bolt-receiving aperture of the foot portion and a second fastener element in the form of a well nut is attached to the bolt to secure the movable member in position on the main body. The distance from the top of the head of the main body to seat portion of the movable member defines the amount of plank overlap.

Accordingly, it is a principal object of the invention to provide a siding tool for facilitating the installation of plank siding on a building by a single person.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
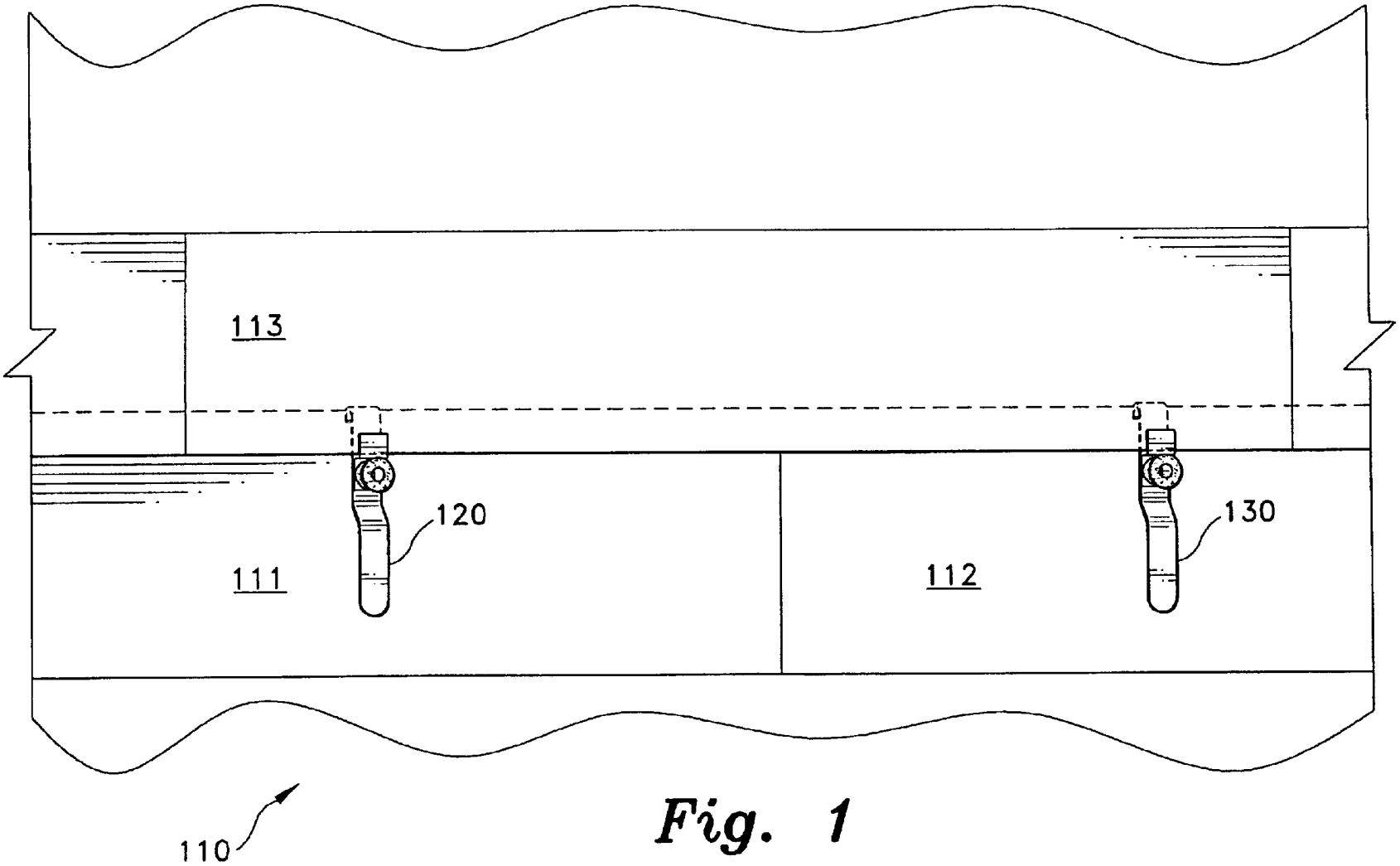
FIG. 1 is an environmental, perspective view of a siding tool according to the present invention.

The present invention provides a tool for facilitating the installation of plank siding on a building by a single person. FIG. 1 shows a pair of siding tools 120 and 130, according to the present invention, mounted on installed planks (111, 112) and supporting an uninstalled plank of siding 113 for fastening to the building.

Figure 3:
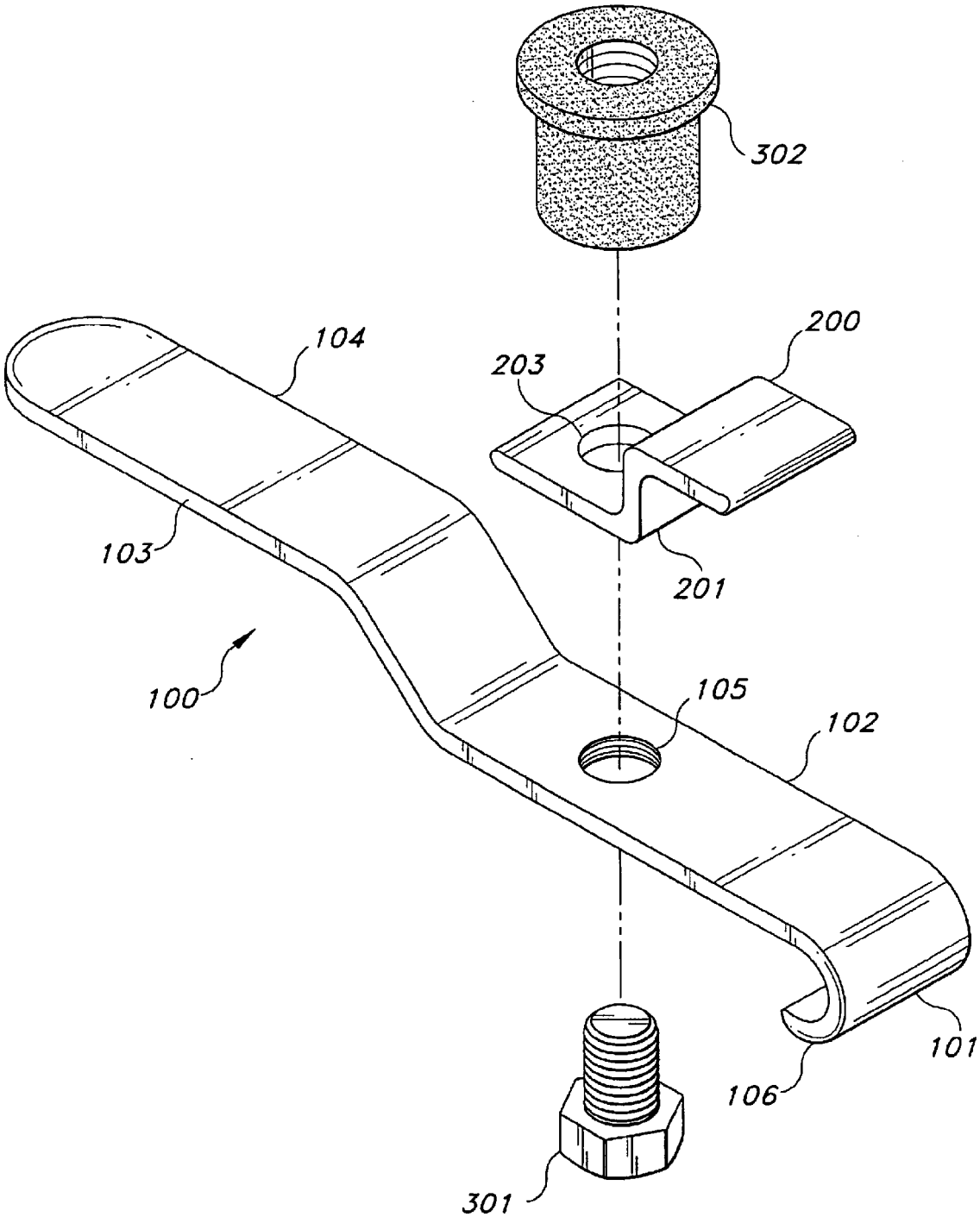
FIG. 3 is an exploded side view of the siding tool according to the present invention.

As best seen in FIG. 3, the main body 100 of the tool is in the form of a flat elongated bar 120. The top end of the bar is bent 180 degree to form a hook 101. The tip portion 106 of the hook 101 is tapered to facilitate insertion behind a previously installed plank of siding 110. The main body includes neck portion 102 attached to the hook 101. The neck portion 102 has a threaded aperture 105 therethrough that is positioned a predetermined distance from the hook 101. The bar further includes two 30-degree bends which form an angled extension portion 103 connected to the neck portion 102 and a handle portion 104 connected to the extension portion 103. The handle portion 104 extends in a spaced parallel relation to the neck portion 102 to facilitate easy grasping of the handle 104 for positioning and removal of the tool.

The tool also includes a movable member 200 in the form of a short flat bar with two 90-degree bends defining a foot portion 202 and a seat portion 201. The foot portion 202 includes a bolt-receiving aperture 203 therethrough. The seat portion 201 of the tool is used for supporting one end of a plank of siding 113 being installed on a building.

A fastener element in the form of a bolt 301 is threadedly received in the threaded aperture 105 in the neck 102 of the main body of the tool. The bolt 301 is passed through the bolt-receiving aperture 203 of the foot portion 202 and a second fastener element in the form of a well nut 302 is attached to the bolt 301 to secure the movable member 200 in position on the main body. The distance from hook 101 at the top of the main body to the seat portion 201 of the movable member 200 defines the plank overlap, preferably 1.5 inches.

Figure 2:
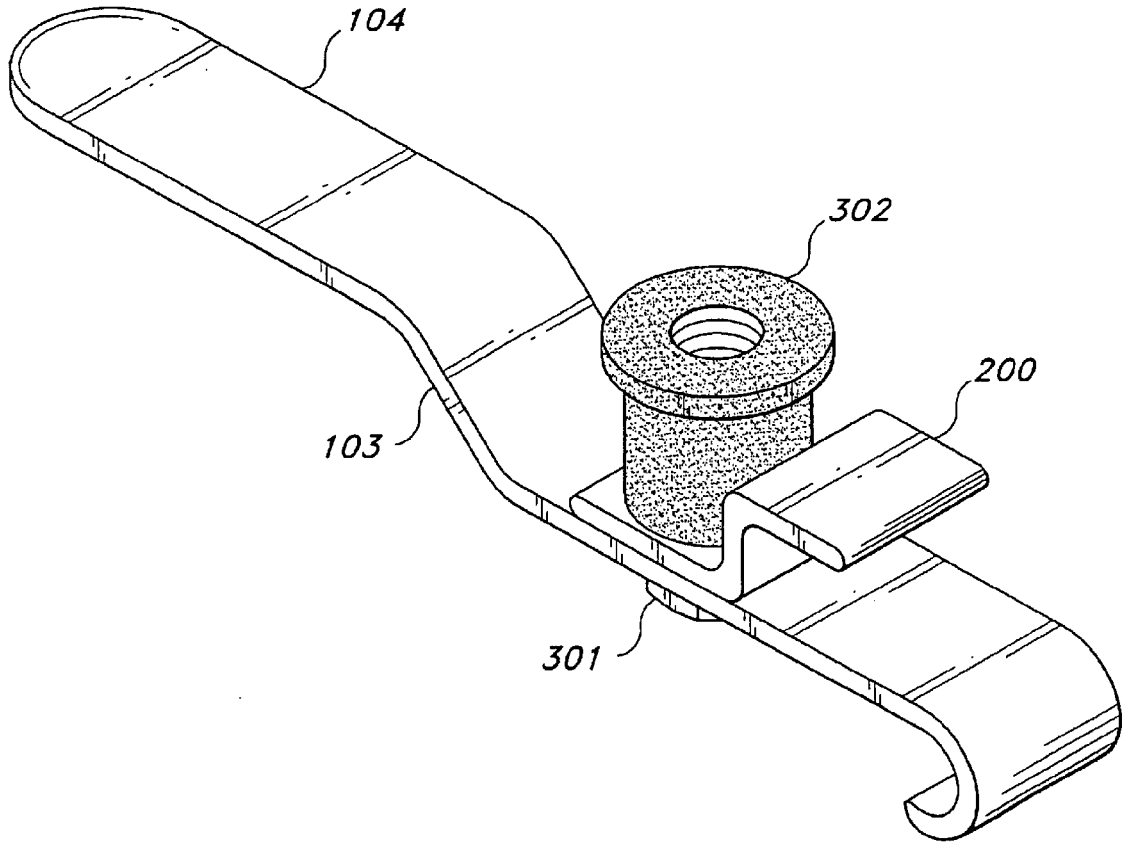
FIG. 2 is a perspective view of the siding tool according to the present invention.

Referring to FIG. 2, after the first row of plank siding (bottom row) is leveled and fastened to the building, a pair of tools are attached by the hooks 101 to one or more of the installed planks of the first row. The tools are spaced apart so as to be of equal distant from the ends of an uninstalled plank. The uninstalled plank 113 is then set upon the seat portions 201 of the tools and fastened to the building. The pair of tools automatically sets the amount of the newly installed plank that overlaps the previously installed planks. Preferably the overlap is set to 1.5 inches. To remove the tools, each well nut 302 is loosened from their respective bolts to allow the plank seats to be pulled away from the plank. Moving the plank seats back makes room for the tools to be pushed upward to free the hooks from behind the lower plank. The tools are then pulled downward to free the tool from between the lower plank and overlapped portion of the newly installed plank.

It is to be understood that the present invention is not limited to the embodiment described above, but encompasses any and all embodiments within the scope of the following claims.

I claim:

1. A siding tool comprising:

a main body in the form of a generally flat elongated bar having a top end and a bottom end, said bar including a hook portion formed at the top end, a neck portion connected to the hook portion, and two 30-degree bends forming an angled extension portion connected to the neck portion and a handle portion at said bottom end;

a movable member in the form of a short generally flat bar having two 90-degree bends therein defining a foot portion with a bolt receiving aperture therethrough and a seat portion, whereby said seat portion receives an uninstalled plank of siding thereon;

a first fastener means connected to said neck portion a predetermined distance from said first end passing through the bolt receiving aperture of said foot portion; and a second fastener means for cooperating with said first fastener means to secure said movable member in position on said main body;

wherein planks of siding are subsequently installed by attaching said hook portion atop a previously installed plank of siding, placing a plank of siding onto the seat portion, securing the plank, loosening said second fastener thereby releasing said seat member from said main body, and removing the hook portion.

2. The siding tool of claim 1, wherein said first fastener means includes a threaded bolt and said neck portion includes a threaded aperture for receiving said threaded bolt.

3. The siding tool of claim 2, wherein said second fastener means includes a well nut.

4. A siding tool comprising:

a main body in the form of a generally flat elongated bar having a top end and a bottom end, said bar including a hook portion formed at the top end, a neck portion having a threaded aperture therethrough connected to the hook portion, and two 30-degree bends forming an angled extension portion connected to the neck portion and a handle portion at said bottom end;

a movable member in the form of a short generally flat bar having two 90-degree bends therein defining a foot portion with a bolt receiving aperture therethrough and a seat portion, whereby said seat portion receives an uninstalled plank of siding thereon;

a first fastener element threadedly received in the threaded aperture of said neck portion and passing through the bolt receiving aperture of said foot portion of said movable member; and a second fastener element for cooperating with said first fastener element to secure said movable member in position on said main body;

wherein planks of siding are subsequently installed by attaching said hook portion atop a previously installed plank of siding, placing a plank of siding onto the seat portion, securing the plank, loosening said second fastener thereby releasing said seat member from said main body, and removing the hook portion.

5. The siding tool of claim 4, wherein said first fastener element is in the form of a threaded bolt and said second fastener element is in the form of a well nut.

6. The siding tool of claim 4, wherein said hook includes a tapered tip portion to facilitate insertion of the tool behind an installed plank of siding.

7. The siding tool of claim 6, wherein said first fastener element is in the form of a threaded bolt and said second fastener element is in the form of a well nut.

* * * * *